US005100291A

United States Patent [19]

Glover

[11] Patent Number: 5,100,291

[45] Date of Patent: Mar. 31, 1992

[54] IMPINGEMENT MANIFOLD

[75] Inventor: Jeffrey Glover, Cincinnati, Ohio

[73] Assignee: General Electric Company, Lynn, Mass.

[21] Appl. No.: 500,609

[22] Filed: Mar. 28, 1990

[51] Int. Cl.[5] ..... F01D 9/00

[52] U.S. Cl. ..... 415/115; 415/116; 415/135; 415/136; 415/177; 415/213.1; 60/39.75; 248/901; 165/82; 165/169; 403/28; 403/408.1; 285/41

[58] Field of Search ..... 415/115, 116, 117, 114, 415/108, 177, 178, 134, 135, 213.1, 136; 60/39.75; 285/41, 62; 248/901; 403/28, 388, 408.1; 165/81, 82, 169

[56] References Cited

U.S. PATENT DOCUMENTS

| | | | |
|---|---|---|---|
| 2,549,819 | 4/1951 | Kane | 415/116 |
| 3,641,766 | 2/1972 | Uehling | 60/262 |
| 4,017,207 | 4/1977 | Bell et al. | 415/115 |
| 4,019,320 | 4/1977 | Redinger, Jr. et al. | 60/226 |
| 4,053,254 | 10/1977 | Chaplin et al. | 415/178 |
| 4,214,851 | 7/1980 | Tuley et al. | 415/115 |
| 4,230,436 | 10/1980 | Davison | 415/1 |
| 4,268,221 | 5/1981 | Monsarrat et al. | 415/116 |
| 4,279,123 | 7/1981 | Griffin et al. | 60/226 |
| 4,329,114 | 5/1982 | Johnston et al. | 415/145 |
| 4,525,998 | 7/1985 | Schwarz | 60/226 |
| 4,553,901 | 11/1985 | Laurello | 415/138 |
| 4,643,638 | 2/1987 | Laurello | 415/136 |
| 4,826,397 | 5/1989 | Shook et al. | 415/116 |
| 4,859,142 | 8/1989 | Burke et al. | 415/178 |

FOREIGN PATENT DOCUMENTS

| | | | |
|---|---|---|---|
| 2062763 | 5/1981 | United Kingdom | 60/39.75 |

*Primary Examiner*—Edward K. Look
*Assistant Examiner*—Christopher M. Verdier
*Attorney, Agent, or Firm*—Nathan D. Herkamp; Jerome C. Squillaro

[57] ABSTRACT

Clearance control is provided by circumferentially segmented cooling manifolds having spray bars located radially outside selected components of the stator casing. Cooling air is directed onto stator components and returns immediately through circuitous paths to improve uniformity of cooling. The spray bars extend through limited circumferential angles to limit distortion due to uneven heating.

13 Claims, 5 Drawing Sheets

FIG. 4
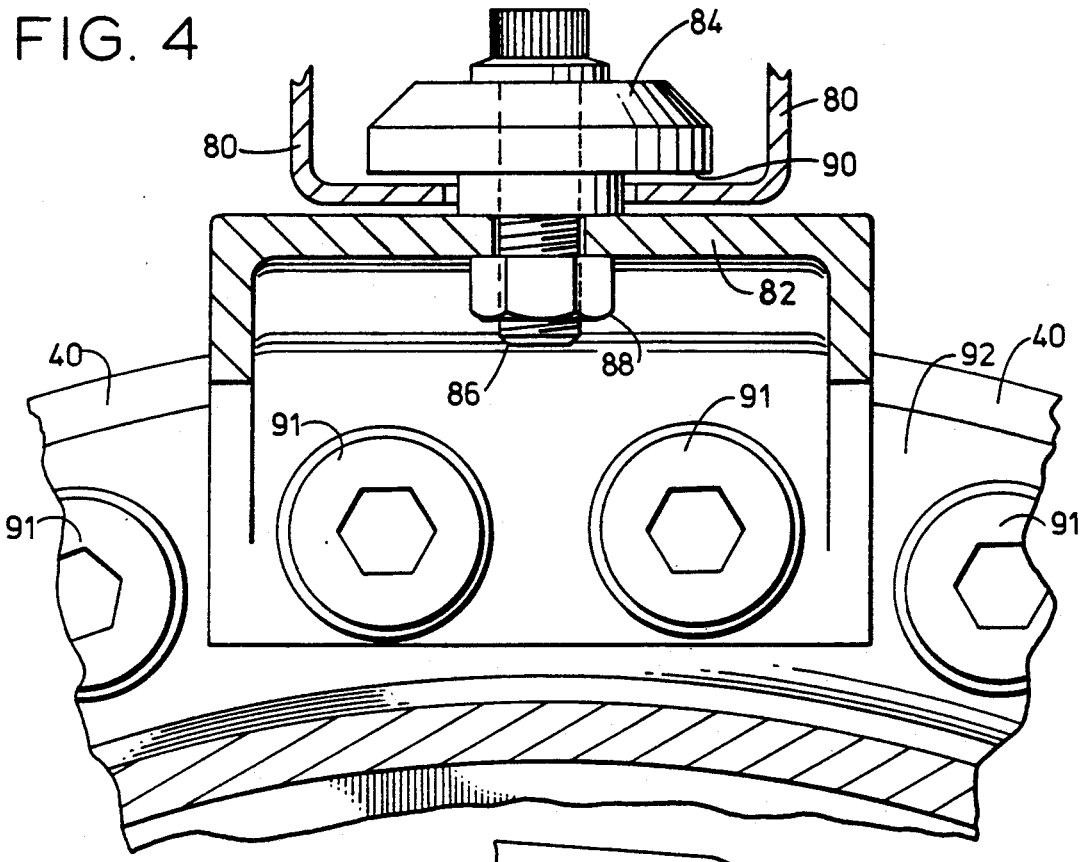
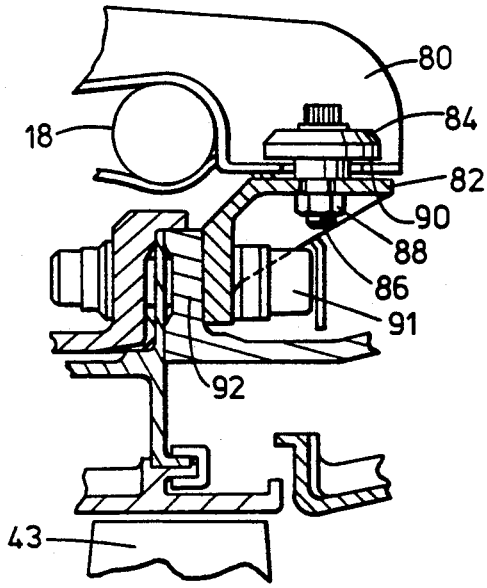
FIG. 4A

IMPINGEMENT MANIFOLD

BACKGROUND OF THE INVENTION

The invention relates generally to gas turbine engines and, more particularly, to an impingement manifold for supplying cooling air to the exterior surface of a casing of a gas turbine engine.

It is understood in the gas turbine art that engine efficiency is improved by minimizing the leakage of hot gases past the turbine. Leakage air does not contribute to the power extracted by the turbine and consequently represents a loss of overall efficiency. Therefore, much effort has been given to limiting clearance between rotor and stator components.

Typically, the prior art has supplied cooling air to gas turbine components to control thermal growth of the turbine casing to minimize the operating clearances. Cooling air is supplied to circular spray bars which impinge cooling air upon circular components surrounding a row of turbine blades. For example U.S. Pat. No. 4,214,851 issued July 29, 1980, to Tuley, et al., and assigned to the assignee of the present invention, discloses a cooling air manifold of an annular shape with radial holes to supply cooling air to stator vanes. To further control cooling, the air supply has been controlled as described in, for example, U.S. Pat. No. 4,230,436, issued to Davison and assigned to the assignee of the present invention. In Davison, two sources of air are mixed according to the demand to provide a cooling flow in response to measured engine operating parameters.

As cooling air passes through the cooling manifold it picks up heat from the turbine casing. The amount of heat absorbed increases as the length of travel of the air in close proximity to the casing increases. One significant limitation of the prior art manifold construction is that a temperature gradient was established circumferentially around the annular spray bars due to the heating of the cooling air as it flows circumferentially from the supply tube around the engine. Uneven cooling allows uneven thermal growth, which limits the amount of performance improvement which can be realized, because the engine design is required to include greater clearance to prevent rubbing of rotor blade tips against the stator structure.

SUMMARY OF THE INVENTION

The present invention includes apparatus to spray cooling air over flanges of a gas turbine stator structure through arcuate segment tubes disposed around a gas turbine stator to apply uniform cooling to the stator components. In a particular embodiment of the present invention, a cooling pattern is selected to provide optimum cooling, and a baffled construction is used to reduce distortion due to external influence on the stator. The baffled construction also provides controlled passage of spent impingement air out of the turbine.

BRIEF DESCRIPTION OF THE DRAWINGS

The present invention is illustrated by way of detailed example in the Figures of the accompanying drawing in which like reference numerals refer to like elements throughout, and in which:

FIGS. 4 and 4A are schematic partial cross-sectional views of a mounting arrangement taken respectively along line 4—4 and 4A—4A of FIG. 3;

DESCRIPTION OF THE PREFERRED EMBODIMENTS

"Inner" is used herein to identify a surface of a component facing radially toward the axis of rotation of the turbine rotor and "outer" is used herein to identify a surface of a component facing radially away from the axis of rotation of the rotor.

Figure 1:
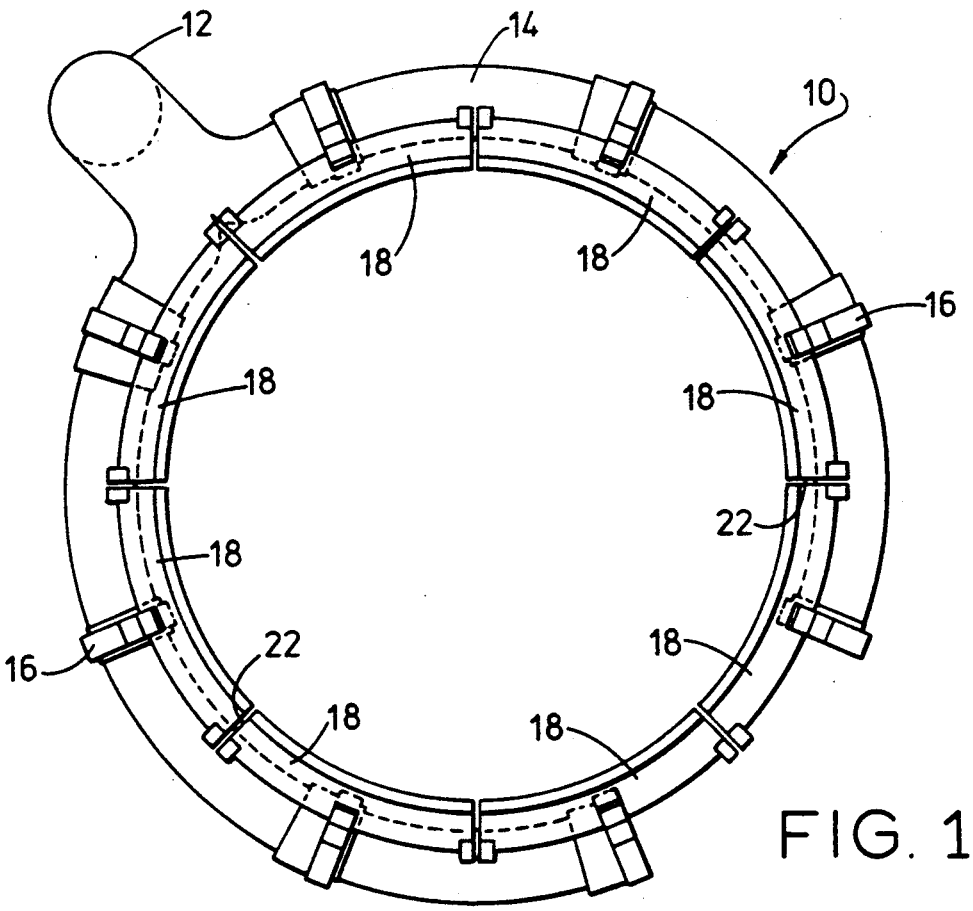
FIG. 1 is a schematic elevation view of a cooling manifold incorporating the present invention.
Figure 2:
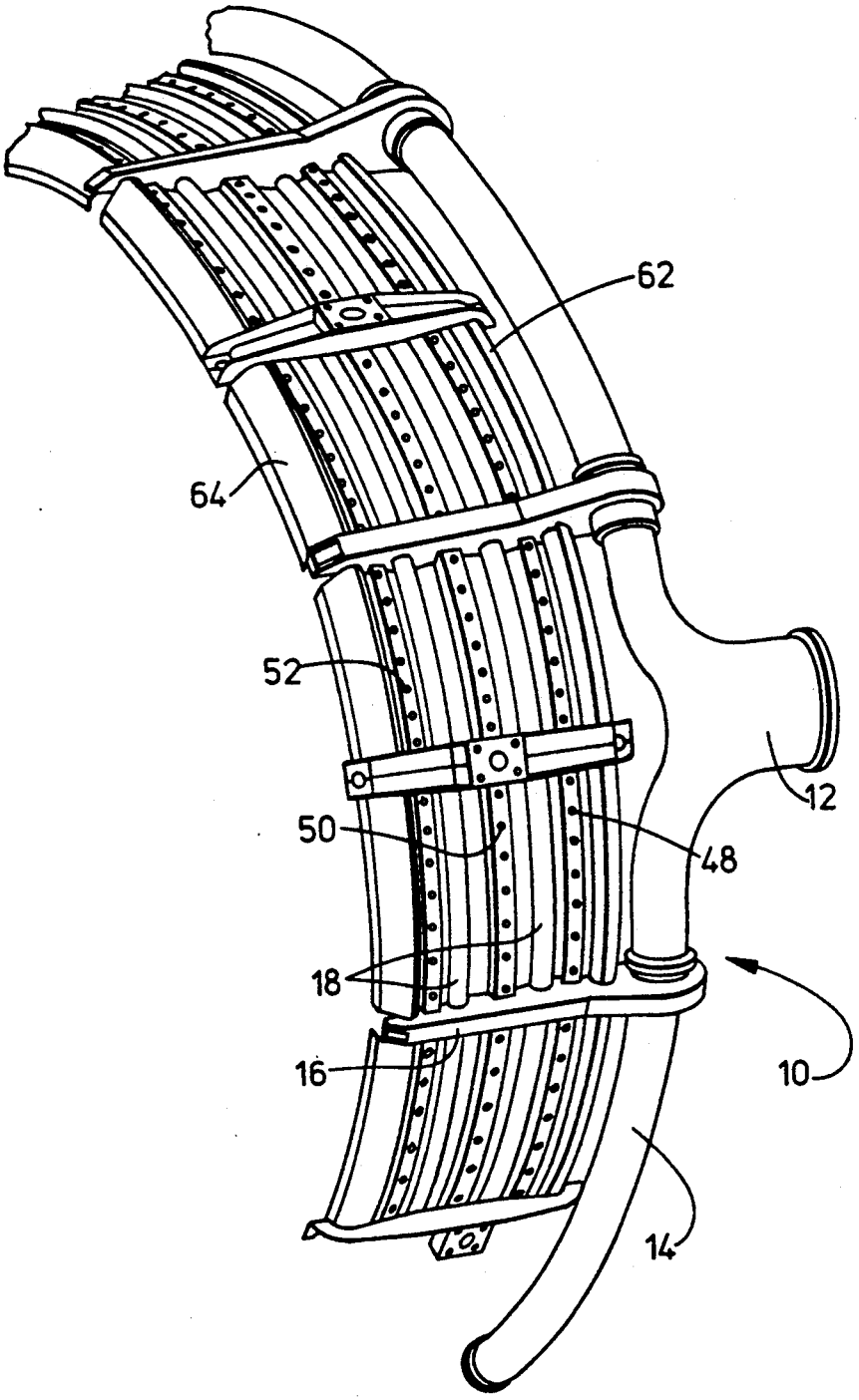
FIG. 2 is a schematic perspective view illustrating a cooling manifold of the present invention.

In the cooling system 10 of the present invention, shown in FIGS. 1 and 2, a supply tube 12 is connected to a circumferential supply pipe 14 which is connected to a plurality of distribution feed pipes 16 located at selected positions around the circumferential supply pipe 14. Each of the distribution feed pipes 16 is connected to at least one spray bar 18. A plurality of spray bars 18 formed as arcuate segments surround the stator 20, shown in FIG. 5 to provide a cooling "ring." A plurality of generally parallel spray bars 18 are assembled into an arcuate manifold 24, shown in FIG. 3. Each spray bar is closed at its respective ends 22. Each distribution feed pipe 16 is connected at about the middle of the arc of spray bar segments 18 so that the total circumferential travel of the air within the segments 18 is about half the arcuate angle of each segment; in the embodiment illustrated in FIG. 1 about one-sixteenth of the circumference of the turbine. The spray bars 18 have rows of openings on the inner surface thereof to spray cooling air on adjacent stator components such as surfaces 93, 94, 95, and 96 of flanges 34, 36, 38 and 40, respectively, shown in FIG. 5 to control the gap 41 between rotor blade 43 and stator ring 45 and the gap 97 between blade 98 and ring 99.

Figure 6:
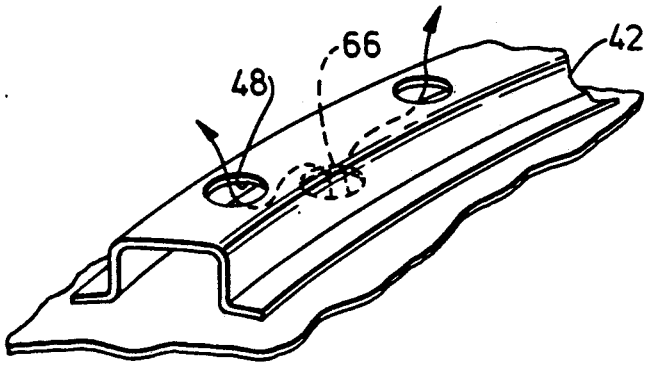
FIG. 6 is a partial schematic perspective view of a baffle of the present invention.
Figure 3:
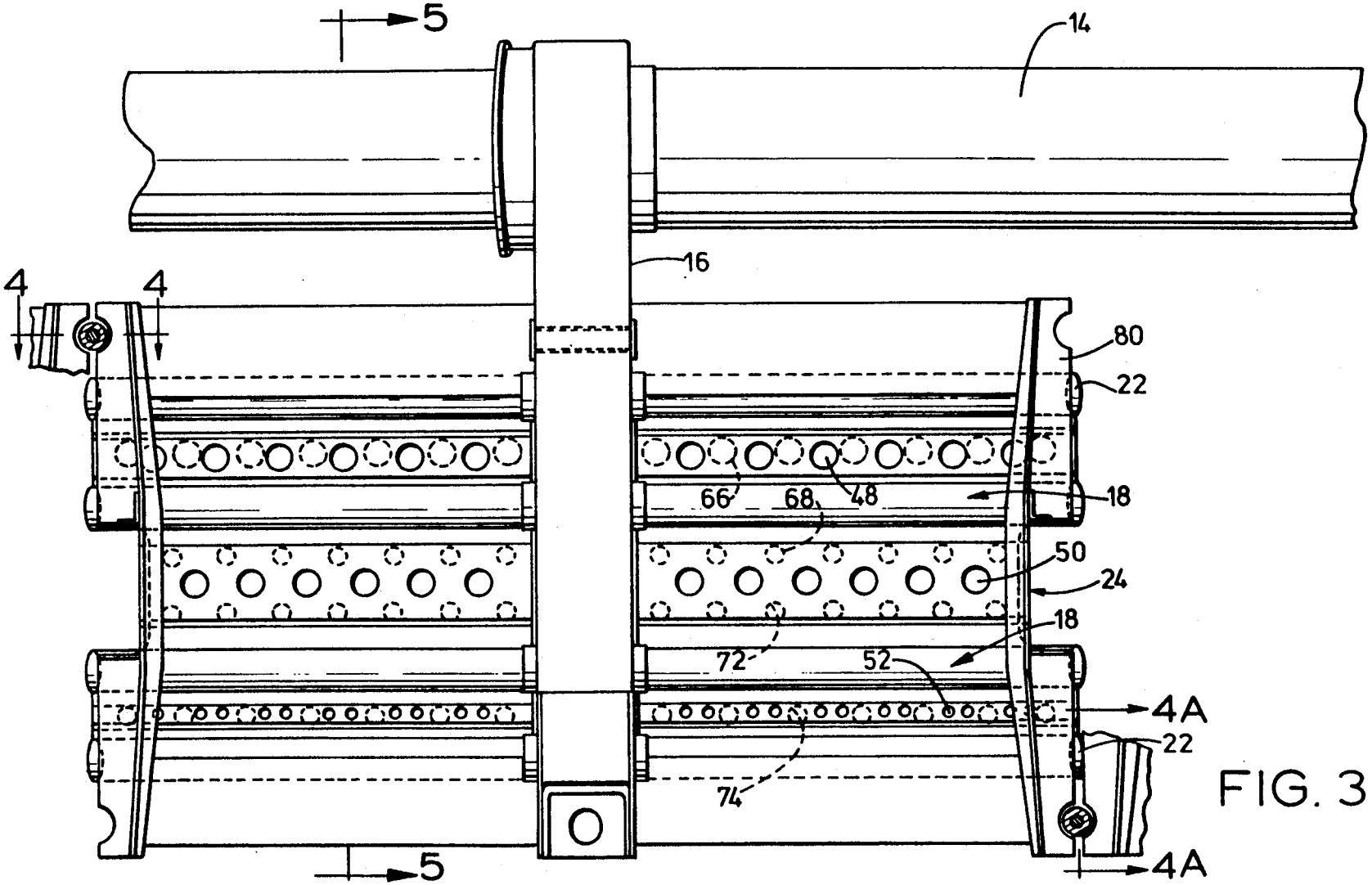
FIG. 3 is a schematic partial plan view of a segment of a cooling manifold incorporating one aspect of the present invention.

The manifold 24 also includes "hat" section baffles 42, 44, and 46 with openings 48, 50, and 52 through their respective flat top portions, a heat shield 54 with openings 66, 68, 72 and 74 therethrough, and end skirts 62, 64. Each of the "hat" section baffles is arranged over a ring of openings in shield 54 such that air exiting from the manifold follows a short but indirect path. For example, in FIG. 6 baffle 42 is positioned so that holes 48 are offset from opening 66. Following this pattern, the openings 66, 68, 72 and 74 in the heat shield are offset from the openings 48, 50 and 52 in respective hat sections 42, 44 and 46 to form a baffled exhaust path for spent impingement air, as shown in FIG. 3. The proximity of the openings 66, 68, 72 and 74, respectively, to the surfaces 93, 94, 95 and 96 cooled respectively by impingement air from cooling passages 26, 28, 30 and 32 provides immediate exit of spent impingement air from the area adjacent the cooled stator flanges, so that air which has absorbed heat from the stator mixes very little with impingement air. This helps ensure that stator components are cooled directly by impingement air to promote uniformity of cooling. The immediate exit of spent impingement air (1) prevents crossflow interference with impingement patterns on adjacent flanges, (2) prevents air currents, which are generally cooler air jets from leaky pipes, etc., in the external environment from directly impinging on the turbine casing, and (3) prevents entrainment of external environment air in the impingement jets.

The heat shield 54 limits transfer of heat from the high pressure turbine casing to the cooling air inside the spray bars. Skirts 62 and 64 shield the manifold and the cooling air passing through it from absorbing heat radiated by stator components such as flanges 34 and 40. The heat shield 54 and skirts 62 and 64 also act as an environmental shield to prevent the outside air from becoming entrained in the cooling airflow which might cause temperature variations in the impingement air. Such variations would cause differences in cooling and thereby limit the effectiveness of the manifold in providing uniform clearance around the circumference of the turbine. Shield 54 contacts arcuate spray bars 18 at limited areas adjacent the holes 26, 28, 30 and 32 to limit conductive heat transfer from the heatshield 54 to the cooling air inside the spray bars 18.

The ends of the manifolds are attached in end-to-end relationship by slipjoint mountings, as shown in FIGS. 4 and 4A, to provide a generally circular cooling manifold. The respective ends of each manifold segment are secured to the casing 92 having fasteners such as bolts 91 (not a part of the present invention) for securing stator components together as shown in FIG. 4. The mounting arrangement allows flanges 80 to move circumferentially relative to each other, but maintains the manifolds in close proximity to each other and to the casing. A channel 82 is rigidly attached to the casing. Spacer 84 is rigidly secured to the channel 82 by bolt 86 and nut 88. Spacer 84 is shaped to provide a gap between the channel 82 and the shoulder 90 of the spacer, so that the flanges 80 are allowed to move relative to each other to accommodate thermal expansion, but are allowed only limited radial motion in order to reduce variance in impingement distance.

The cooling air circulates to cool the stator components as follows. Cooling air is bled from the compressor of the gas turbine engine and supplied via supply tube 12 to the circumferential supply pipe 14. Typically, the cooling air is bled from a stage or stages of the compressor selected to provide the air pressure and temperature required to accomplish the desired cooling. Air flows, as shown by arrow 70 in FIG. 5, through each of the respective pipes 16 to spray bars 18. Air exits the respective spray bars to impinge on surfaces 93, 94, 95 and 96 of respective stator casing flanges 34, 36, 38, and 40 and passes via return flow passages 66, 68, 72, 74 to the baffles and exits via holes 48, 50, and 52 into the area external to the engine cooling system 10.

The thermal gradient experienced by cooling air passing through the arcuate manifolds of the present invention is limited by the fact that the cooling air travels through a limited circumferential angle, about one-sixteenth of the circumference of the casing shown in FIG. 1. Therefore, the present invention supplies cooling air at a more uniform temperature to the entire circumference of the stator casing flanges, allowing more nearly uniform control of thermal expansion. Distortion caused by the circumferential thermal gradient is significantly reduced. The inventor has found that arcuate segments extending through an angle of no more than 90 degrees significantly reduce distortion, and that for large gas turbine stators limiting the circumferential extent of the spray bar segments to about 45 degrees, so that eight arcuate segments surround the stator, provides superior cooling to the stator casing. It is to be understood that any number of spray bar segments of any arcuate extent could be used in a particular cooling arrangement to surround a stator casing, depending on considerations of weight, spacing and complexity of the tubing.

Figure 5:
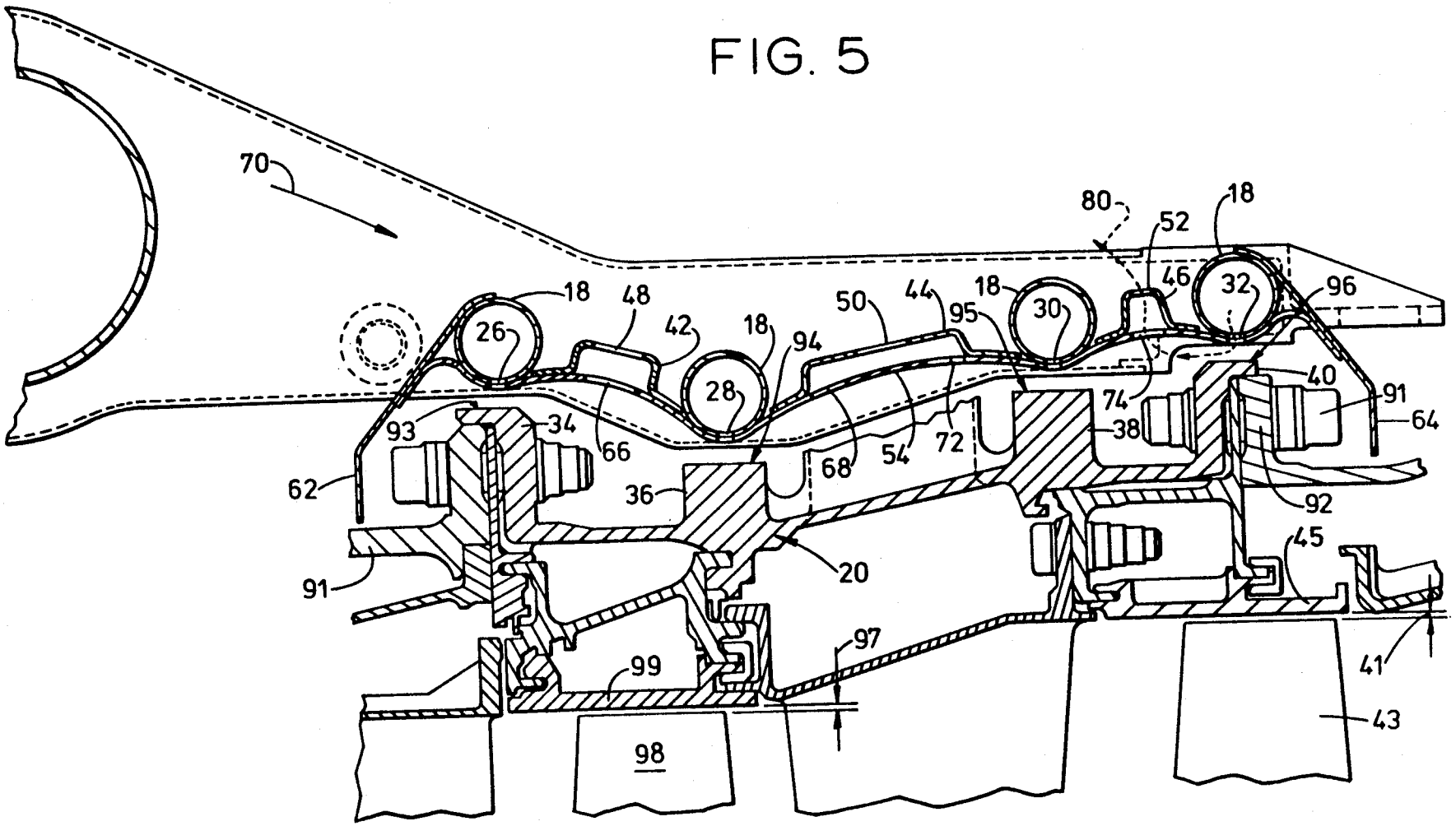
FIG. 5 is a schematic partial cross-sectional view of a cooling arrangement taken along line 5—5 of FIG. 3 incorporating the present invention.

It will be understood that many modifications and combinations may be made by one skilled in the art without departing from the scope of the invention. For example, while FIG. 5 shows four spray bars, any number of spray bars could be selected to apply cooling air to a desired number of locations along the axis of a gas turbine. Also, mounting arrangements other than that shown in FIG. 4 could be used to provide flexible mounting of the manifold could be used.

What is claimed as novel and desired to be secured by Letters Patent of the United States is:

1. An impingement manifold, comprising:

a plurality of generally arcuate manifold segments having cooling passages through an inner wall thereof for flowing cooling air therefrom in a generally radially inward direction to impinge on a generally circular surface to be cooled;

a plurality of feed pipes for supplying cooling airflow into a center portion of each respective one of said arcuate manifold segments; and mounting means disposed at the ends of said segments for flexibly securing said plurality of segments into a generally circular cooling manifold.

2. The invention of claim 1 further comprising:

a heat shield disposed radially inside said arcuate manifold segments for thermally shielding said segments from heat radiated outward from the surface being cooled and for preventing external air from impinging on said surface to be cooled; and a baffle means surrounding said heat shield for providing a controlled immediate exhaust passage for exhausting spent impingement cooling air.

3. The invention of claim 2 wherein each of said arcuate segments extends through an arc having a circumferential angle of about 45 degrees to about 90 degrees.

4. The invention of claim 3 wherein said baffle means comprises:

a plurality of exit passages through said heat shield offset from and immediately adjacent said cooling passages to allow passage of air from a space adjacent the surface to be cooled radially outward through said exit passages; and hat section baffles extending circumferentially along and radially outside the exterior surface of said heat shield and having exhaust passages therethrough offset from and immediately adjacent the exit passages through said heat shield.

5. The invention of claim 4 wherein each of said arcuate segments comprises;

a plurality of arcuate spray bars arranged in generally parallel relationship and spaced to provide cooling air spray respectively onto a plurality of surfaces adjacent respective ones of said spray bars.

6. A cooling system for supplying cooling air to the exterior surface of casing components of a gas turbine engine, comprising:

a plurality of generally arcuate tubular segments disposed in end-to-end relationship to each other to form a segmented cooling ring surrounding a selected portion of a turbine stator casing;

a plurality of generally axially extending feed pipes each connected near a center portion of a respective one of said segments;

a plurality of cooling passages penetrating a radially inner surface of each respective one of said arcuate segments for providing a cooling airflow to said selected portion of said casing; and a cooling air supply means for supplying a flow of cooling air to each of said feed pipes, said cooling air supply means comprising a generally circumferential supply pipe for providing a supply of cooling air to each respective one of said axially extending feed pipes.

7. The invention of claim 6 further comprising:

slipjoint mounts disposed at the ends of said segments for flexibly securing said plurality of segments to said casing.

8. The invention of claim 7 wherein each of said arcuate segments comprises;

a plurality of arcuate spray bars arranged in generally parallel relationship and spaced to provide cooling air spray onto the surfaces of respective selected stator components of said turbine.

9. The invention of claim 7, further comprising:

a heat shield disposed radially inside said segments for thermally shielding said segments from heat radiated outward from the surface of said turbine stator and for preventing external air from impinging on said surfaces of said stator components; and a baffle means surrounding said heat shield for providing controlled immediate exhaust passage for exhausting spent impingement cooling air.

10. The invention of claim 6 wherein each of said arcuate segments extends through an arc having a circumferential angle of about 45 degrees to about 90 degrees.

11. The invention of claim 9 wherein said baffle means comprises:

a plurality of exit passages through said heat shield offset from and immediately adjacent said cooling passages to allow passage of air from the space adjacent the surfaces to be cooled radially outward through said exit passages; and hat section baffles extending circumferentially along and radially outside the exterior surface of said heat shield and having exhaust passages therethrough offset from and immediately adjacent the exit passages through said heat shield.

12. The invention of claim 11 wherein each of said arcuate segments comprises;

a plurality of arcuate spray bars arranged in generally parallel relationship and spaced to provide cooling air spray respectively onto a plurality of radially outer surfaces of respective selected stator components of said turbine.

13. The invention of claim 12 wherein each of said arcuate segments extends through an arc having a circumferential angle of about 45 degrees to about 90 degrees.

* * * * *